United States Patent [19]

Derome

[11] Patent Number: 5,027,923

[45] Date of Patent: Jul. 2, 1991

[54] EXTENSION DEVICE FOR A LADDER

[76] Inventor: James N. Derome, P.O. Box 32, Ely, Vt. 05044-0032

[21] Appl. No.: 593,052

[22] Filed: Oct. 5, 1990

[51] Int. Cl.[5] ..... E06C 7/00

[52] U.S. Cl. ..... 182/201; 248/188.2; 182/111

[58] Field of Search ..... 108/201, 202, 111, 107, 108/108, 214, 129; 248/188.2, 188.5, 188.9, 188.8

[56] References Cited

U.S. PATENT DOCUMENTS

| | | | |
|---|---|---|---|
| 440,185 | 11/1890 | Myers | 182/201 X |
| 1,266,466 | 5/1918 | Hill | 182/201 |
| 2,205,869 | 6/1940 | Wakeman | 182/108 X |
| 2,845,719 | 8/1958 | Thomiszer | 182/129 X |
| 2,911,134 | 11/1959 | Derby et al. | 182/201 |
| 2,914,135 | 11/1959 | Crouch | 182/201 |
| 3,311,337 | 3/1967 | Hagen | 248/188.5 X |
| 4,761,092 | 8/1988 | Nakatani | 248/188.5 X |
| 4,766,976 | 8/1988 | Wallick, Jr. | 182/201 |

*Primary Examiner*—Karen J. Chotkowski

*Attorney, Agent, or Firm*—Berman, Aisenberg & Platt

[57] ABSTRACT

An attachment for a ladder includes a housing and an extensible leg. The housing is clamped to the side of a ladder, and the extensible leg is extended to engage the ground after the ladder has been placed level. A bubble level is provided for visually determining when the ladder is level.

7 Claims, 2 Drawing Sheets

FIG. 3
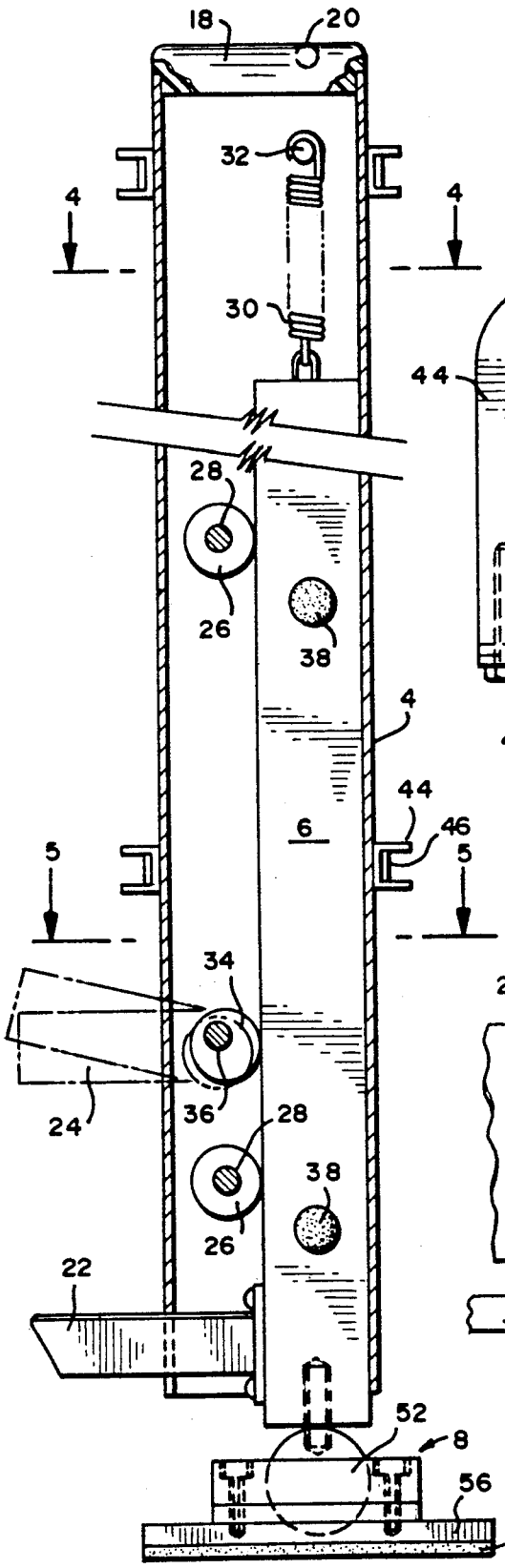
FIG. 4
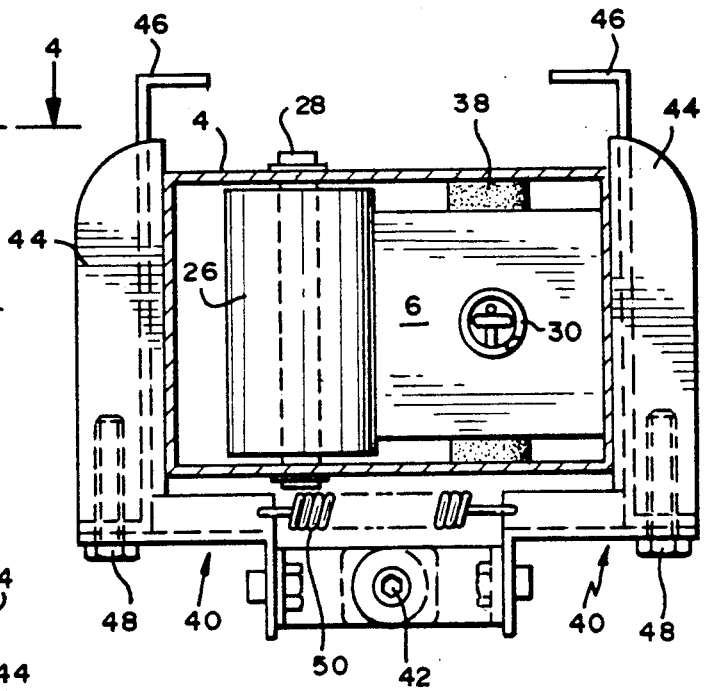
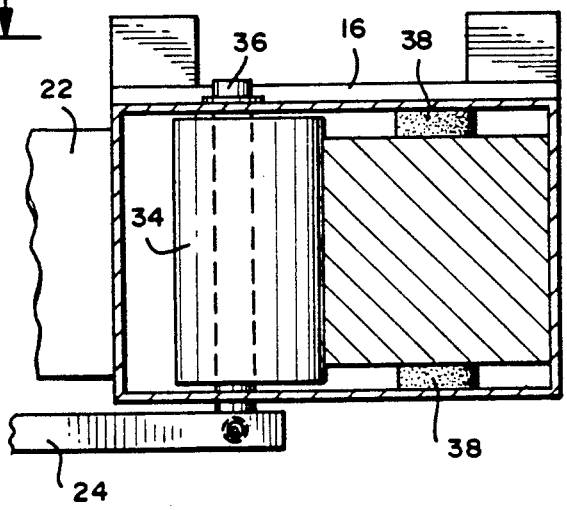
FIG. 5

EXTENSION DEVICE FOR A LADDER

TECHNICAL FIELD

This invention relates to a device for the adjustable extension of one or both legs of a ladder to allow use on an uneven surface.

BACKGROUND ART

Attachments for a ladder which provide an extendable leg are known. For example, U.S. Pat. Nos. 1,177,069 (Verow), 2,555,036 (Husted), 2,783,928 (Cox), 2,911,134 (Derby), 2,914,135 (Crouch), and 4,627,515 (Studer) show various arrangements which provide an extensible leg for holding a ladder level on an uneven surface. Some of these are removably attached to the ladder while others are permanent parts of the ladder structure.

It is also known to provide a ladder with a bubble level to indicate when the ladder is in a desired orientation. For example, U.S. Pat. Nos. 2,845,719 (Thomiszer) and 4,554,994 (Weiner) show bubble levels for indicating when a ladder is leaning at a proper angle against a wall.

SUMMARY OF THE INVENTION

The prior art does not provide a levelling device for a ladder which is easily attached to a leg of the ladder or which is smoothly and easily operated to extend the extensible leg to any desired distance.

In accordance with the invention, an attachment for a ladder comprises a rectangular housing and an extensible leg carried within the housing. The housing has guides for aligning it with a leg of a ladder and clamps for removably securing the housing to the ladder leg.

The housing includes two rollers longitudinally spaced from each other along the housing and laterally spaced from a longitudinal wall of the housing for guiding the extensible leg. The extensible leg slides smoothly between the rollers and the wall of the housing.

A locking mechanism is mounted in the housing and comprises a cam having a lobe which engages the extensible leg as it is moved upward, or into the housing. As the leg moves upward, it engages the lobe which wedges the extensible leg between the lobe and the wall of the housing to lock the extensible leg in the selected location. The leg may be moved downward, or away from the housing by pushing it down which causes the cam to rotate away from the extensible leg. A step is provided on the extensible leg for engaging the user's foot to force the extensible leg out of the housing. A release lever is attached to the cam for rotating the cam away from the extensible leg to release it for retraction further into the housing.

A spring is attached between the housing and the extensible leg for causing the extensible leg to be withdrawn automatically upon release of the locking cam.

The clamps include two parts which are pivotally mounted to the outside of the housing. Each part includes a base and a hook. The base lies along one side of the housing when in an operative position, and the hook extends over the side of the ladder to clamp the ladder to the housing.

A bubble level is attached to the top of the housing within easy view of a user for indicating when the rungs of the ladder are level.

In use, a housing is attached to one or both of the legs of a ladder by the clamps. The user levels the ladder by raising one side of the ladder while viewing the bubble level. Then, the user places his foot on the step whereby the extensible leg moves downward to engage the ground. Because of the action of the cam lock, the extensible leg remains in this position, which causes the ladder to remain in the level position and ready for use.

BRIEF DESCRIPTION OF THE DRAWINGS

FIG. 3 is a longitudinal cross section of the extension device of FIG. 1.

FIG. 4 is a cross section taken along line 4—4 of FIG. 3.

FIG. 5 is a cross section taken along line 5—5 of FIG. 3.

DETAILED DESCRIPTION OF THE DRAWINGS

Figure 1:
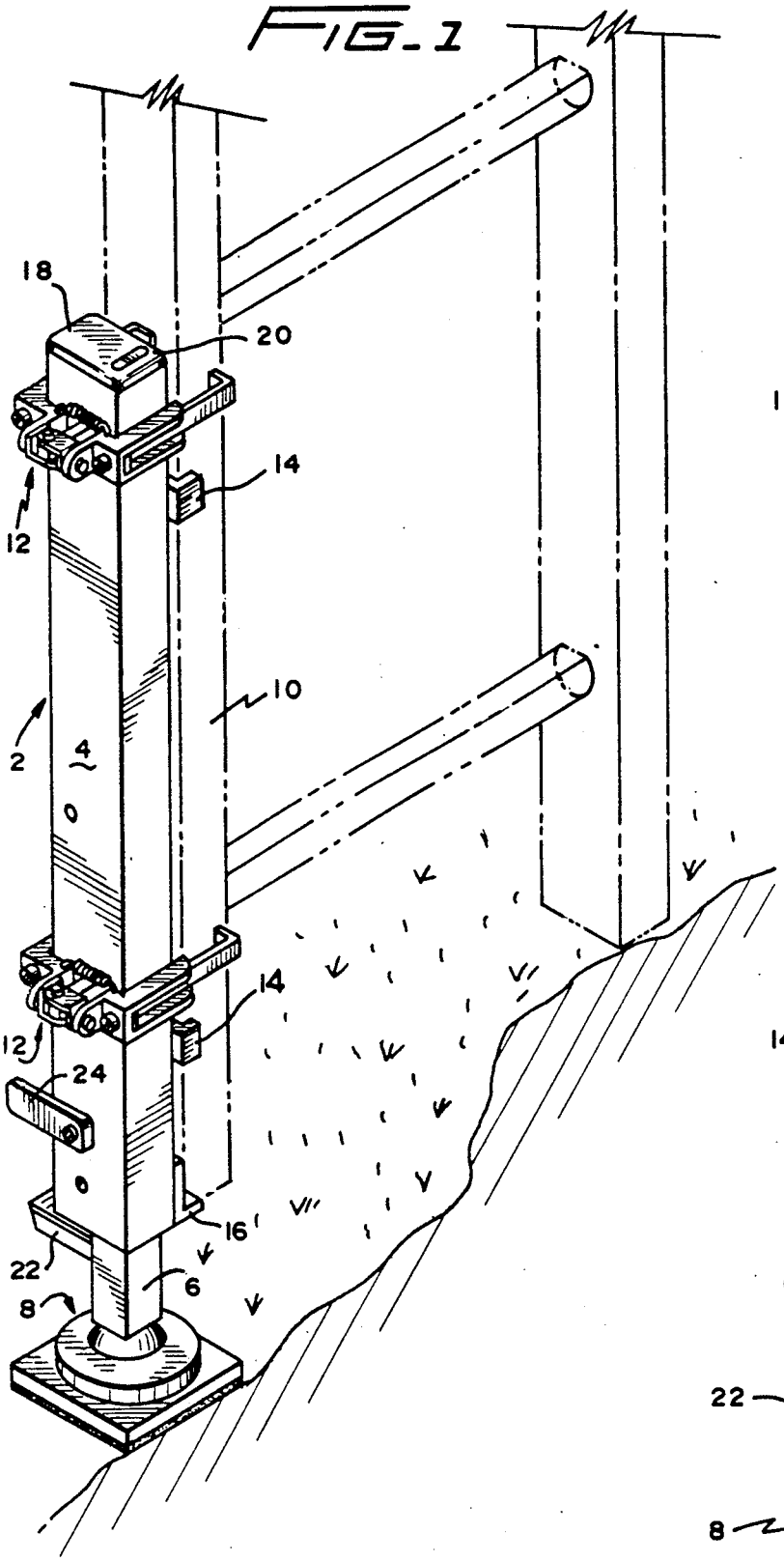
FIG. 1 is a perspective of an extension device in accordance with the invention attached to a ladder.
Figure 2:
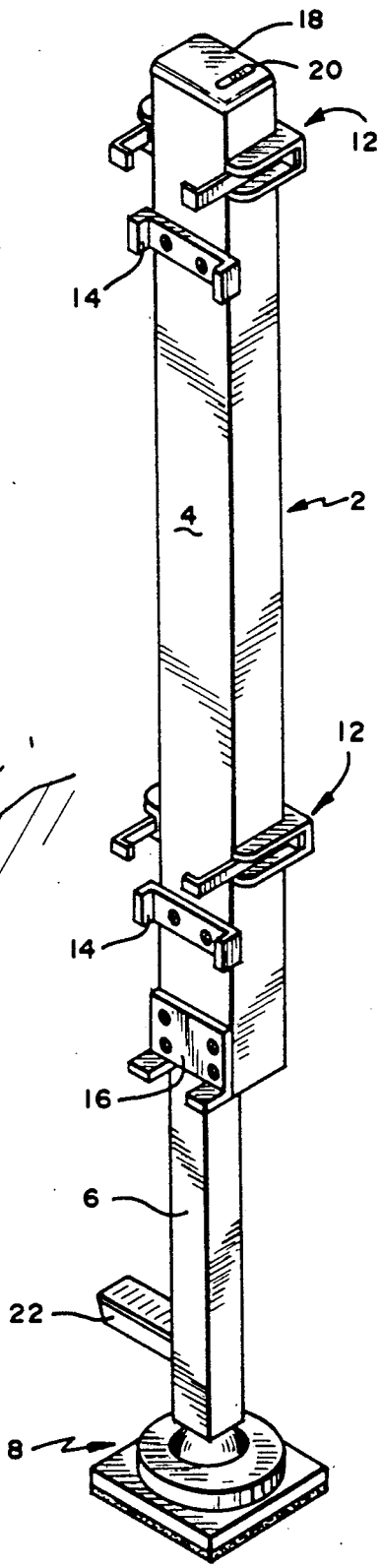
FIG. 2 is a perspective of an extension device in accordance with the invention.

With reference to figures 1 and 2, an extension device 2 comprises a housing 4 and an extensible leg 6. The device shown if FIG. 2 may be more easily applied to the left side of a ladder, while that shown in FIG. 1 will generally be placed on the right side. Either may be placed on either side of the ladder, however.

The extensible leg 6 has a foot 8 attached to the bottom thereof for engaging the ground or other surface upon which the ladder has been placed. The housing 4 is held to the side 10 of a ladder shown in phantom lines by two clamps 12. Aligning brackets 14 are spaced along the housing to maintain the side of the ladder longitudinally aligned with the housing, and a stop 16 is located at the bottom of the housing to support the side of the ladder with respect to vertical loads.

A cap 18, preferably made of plastic, covers the top of the housing and includes a bubble level 20 for determining when the ladder is level with respect to the direction of the ladder rungs.

A foot step 22 extends from the extensible leg for engagement by the foot of a user to force the extensible leg in a downward direction out of the housing.

A locking mechanism to be described more fully below retains the leg in an extended position against retraction into the housing. A release lever 24 is pivotally mounted to the housing to release the locking mechanism to allow the extensible leg to be pulled back into the housing by a spring as shown in FIGS. 3 and 4.

FIGS. 3 through 5, show the interior construction of the attachment of FIG. 1.

The extensible leg 6 is located between a wall of the housing 4 and two rollers 26. These rollers are mounted to the housing by shafts 28 for rotation, the shafts extending between opposed sidewalls of the housing. As the extensible leg is pulled out of the housing, it moves within the space between the sidewall and the rollers 26. One end of a spring 30 is attached to a pin 32 which is secured to the housing 4, and the other end is secured to the top of the extensible leg. Thus, the spring is stretched as the extensible leg 6 is extended and pulls the extensible leg back into the housing when the locking mechanism is released.

The locking mechanism preferably comprises a cam 34 eccentrically mounted on a shaft 36. The cam is located so that its outer surface will engage the surface of the extensible leg 6 and rotate in a counter clockwise direction as viewed in FIG. 3 to clamp the extensible leg between the cam and the wall of the housing to prevent retraction of the extensible leg. The release lever 24 is secured to either the shaft or the cam such that it will rotate in a clockwise direction to release the locking mechanism and permit the extensible leg to be withdrawn into the housing upon lifting of the release lever 24. The release lever is designed to release the locking mechanism upon lifting of the lever to ensure that it is not inadvertently operated by the foot of a user. Only vertical motion will release the locking mechanism.

Two plastic pads 38 are placed on each side of the extensible leg to reduce friction between the side walls and the extensible leg. These may be cemented to the side walls or secured in any desired manner.

Each of the clamps 12, comprises two pivotally mounted parts 40 which are secured to the housing at a pivot 42. Each part includes a base 44 which lies flush with the side of the housing when in a clamping position as shown and a hook 46 which is carried by the base and is movable with respect to it.

The hooks are attached to the base by adjusting screws 48 which allow the hooks to be extended to hook over the side of the ladder and then pulled back to clamp the side tightly. A spring 50 urges the two parts 40 together to assist in attachment of the device to the ladder.

The foot preferably includes a universal joint such as the ball and socket joint 52 shown. A variety of other joints may, however, be used. A pad 54 of non-skid material is placed on the bottom of the foot plate 56.

It will be appreciated that a novel attachment for a ladder has been described which is easily attached to a ladder, allows quick visual determination of when the ladder is level, and provides an easily extended leg to maintain the ladder level. Modifications within the scope of the appended claims will be apparent to those of skill in the art.

I claim:

1. Apparatus comprising a housing, clamp means for removably attaching said housing to a leg of a ladder, extensible leg means mounted in said housing and movable with respect to said housing for providing an extendable leg for said ladder, and a spring attached between said housing and said extensible leg for urging said extensible leg into said housing, wherein said housing comprises first and second spaced rollers for directing the movement of said extensible leg in a direction parallel to the direction of said leg of said ladder, an eccentric roller for engaging said extensible leg when in a first position and for allowing movement of said extensible leg when in a second position, and a handle attached to said eccentric roller for rotating said eccentric roller to said second position, and wherein said extensible leg comprises step means for engagement by a foot of a user to extend said extensible leg.

2. Apparatus according to claim 1 wherein said first and second spaced rollers are on one side of said extensible leg and said eccentric roller forces said extensible leg against a side of said housing when in said first position.

3. Apparatus according to claim 2 wherein said housing further comprises a cap having level indicating means therein for indicating when rungs of said ladder are level.

4. Apparatus according to claim 1 wherein s id clamp means comprises first and second parts pivotally connected to said housing, each of said first and second parts comprising a base for extending along a side of said housing, a hook for engaging said leg of a ladder, and adjusting means for adjusting the position of said hook with respect to said base.

5. Apparatus according to claim 4 wherein said hook includes a threaded hole and said adjusting means comprises a screw which engages threads in said threaded hole.

6. Apparatus according to claim 5 further comprising a spring for urging said first and second parts toward each other.

7. Apparatus according to claim 6 further comprising first and second aligning brackets for aligning said housing along the side of said leg of a ladder.

* * * * *